US007762746B2

(12) United States Patent
Berenyi

(10) Patent No.: US 7,762,746 B2
(45) Date of Patent: Jul. 27, 2010

(54) SILT FENCING SYSTEM

(76) Inventor: Gary Berenyi, 139 Island Park Dr., Charleston, SC (US) 29492

( * ) Notice: Subject to any disclaimer, the term of this patent is extended or adjusted under 35 U.S.C. 154(b) by 0 days.

(21) Appl. No.: 11/826,845

(22) Filed: Jul. 19, 2007

(65) Prior Publication Data

US 2009/0022552 A1 Jan. 22, 2009

(51) Int. Cl.
*E02B 7/00* (2006.01)

(52) U.S. Cl. ..... 405/302.7; 405/302.6; 405/115; 405/114; 405/15

(58) Field of Classification Search ..... 405/302.7, 405/114, 115, 15, 16, 17, 21, 302.6
See application file for complete search history.

(56) References Cited

U.S. PATENT DOCUMENTS

| | | | | |
|---|---|---|---|---|
| 898,984 | A | 9/1908 | McFarlane | |
| 3,966,172 | A | 6/1976 | Garrett | |
| 4,136,995 | A | 1/1979 | Fish | |
| 4,240,615 | A | 12/1980 | Sickler | |
| 4,511,286 | A | 4/1985 | Hardacre | |
| 4,692,060 | A * | 9/1987 | Jackson, III | 405/115 |
| 4,930,718 | A * | 6/1990 | Lancour et al. | 242/557 |
| 5,039,250 | A | 8/1991 | Janz | |
| 5,108,224 | A * | 4/1992 | Cabaniss et al. | 405/302.7 |
| 5,419,659 | A * | 5/1995 | Mercer | 405/302.7 |
| 5,605,416 | A | 2/1997 | Roach | |
| 5,658,096 | A * | 8/1997 | Von Kanel | 405/302.7 |
| 5,921,709 | A | 7/1999 | Baum et al. | |
| 6,499,435 | B2 | 12/2002 | Markham | |
| 6,616,383 | B2 | 9/2003 | Janz | |
| 6,692,188 | B1 * | 2/2004 | Walker et al. | 405/115 |
| 6,922,953 | B1 | 8/2005 | Lewis | |
| 7,008,143 | B1 | 3/2006 | Wolfe | |
| 7,048,474 | B2 * | 5/2006 | Tabler | 405/302.7 |
| 2006/0076544 | A1 | 4/2006 | Kurple | |
| 2006/0257209 | A1 * | 11/2006 | Li | 405/110 |
| 2007/0042197 | A1 | 2/2007 | D'Andreta et al. | |

FOREIGN PATENT DOCUMENTS

| | | |
|---|---|---|
| DE | 4212224 | 10/1993 |

* cited by examiner

*Primary Examiner*—Frederick L Lagman
(74) *Attorney, Agent, or Firm*—Harness, Dickey & Pierce, P.L.C.

(57) ABSTRACT

A transportable and reusable silt fencing system for use at a construction site to prevent sediment and soil erosion comprises tension rods, a male section, a female section, and a fencing material having sleeve supports for the rods to slide in and support the fencing material. The tension rods are collapsible. The rods collapse when a truck drives over the fence, but re-assume their original form once the truck has passed. If a fence longer than the fencing section is required, additional fencing sections may be attached by connecting a male section of one fence section with the female section of another fence section.

9 Claims, 6 Drawing Sheets

SILT FENCING SYSTEM

BACKGROUND OF THE INVENTION

1. Field of the Invention

The present invention pertains to the art of fences and, more particularly, silt fencing for preventing soil erosion.

2. Discussion of the Prior Art

Silt fences are often used as barriers to sediment, particularly in connection with preventing soil erosion at construction sites. In fact, many counties in the United States have enacted ordinances requiring the use of erosion control fencing at both residential and commercial building locations. Conventional silt fences are made by driving wooden stakes into the ground and stapling a partially buried, flexible plastic fencing material to the wooden stakes. While appearing simple to construct, this type of silt fence is actually very inefficient and costly. For instance, care must be taken when driving the wooden stakes into the ground as telephone, cable and other wires may be present below the surface. In addition, mainly because the fencing material will tend to tear when attempting to detach it from the stakes, these types of fencing arrangements are generally designed for one-time use. That is, both the fencing material and the wooden stakes are often discarded after being removed from a given construction site.

Attempts have been made to provide a maintenance-free silt fence. For example, Shea, U.S. Pat. No. 5,758,868, proposed a silt fence that eliminates the need to staple the fencing material to a wooden stake. In Shea, post units are inserted into the ground with each post unit having two hollow elongated tubes. Each of the outer tubes includes a slit along their length, enabling a rigid rod attached to a flexible fencing material to be inserted therein. With this construction, Shea's invention requires post units driven into the ground, making the fence difficult to install and limiting its transportability.

Other attempts have been made to provide a sediment and erosion control apparatus that is easily and quickly installed, inexpensive, and reusable. These attempts include a triangularly shaped foam barrier that does not require wooden stakes. An apron is disposed around the foam barrier wherein the apron is anchored to a ground surface. Since the sediment and erosion apparatus is made of foam, a truck can easily drive over it. However, the barrier is often replaced because the foam deteriorates and it develops a smell. When the barrier needs to be replaced, the whole barrier needs to be replaced, increasing the costs to maintain the barrier. In addition, since the foam barrier is one piece and not very compressible, the barrier is not easily storable.

SUMMARY OF THE INVENTION

The present invention is directed to a reusable, transportable and storable silt fencing system. The silt fencing system preferably includes a plurality of fencing sections that are connected together. Each fencing section includes numerous parts that can be individually replaced without replacing a whole fencing section.

Each fencing section comprises a male member or first framing member, a female member or second framing member, rods and a fencing material. The fencing material may be made of any conventional material used to prevent soil and sediment erosion. The fencing material includes sleeve supports and is attached to the male and female members, preferably by glue.

To assemble the fencing section, front ends of the rods are inserted into slots, adapted to hold the ends of rods, of a male or female framing member. The rods are then guided through corresponding sleeve supports in the fencing material. Front ends of the rods are inserted into slots in the remaining male or female member. The fencing section may be disassembled by pulling the rods out of the either the male or female member so that the rods are no longer in the sleeve supports. Removing the rods allows the fencing material attached to the male member and female member to be compressed and easily transported.

The rods are collapsible, i.e., the rods can readily bend or flex and re-assume its original position. The collapsibility of the rods allows the fence to be driven over by a truck and re-assume its original form once the truck has passed.

In one preferred embodiment of the invention, the rods are telescopic. When the rods are telescopic, the fencing section may be kept in an assembled state and compressed to allow for easy transportation.

The design of the fencing section enables a fence, with a length longer than the fencing section, to be easily assembled. The male member of the fencing section is inserted into a second female member of a second fencing section, creating a fence with a length of two fencing sections. The process may be continued until a desired length is reached.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
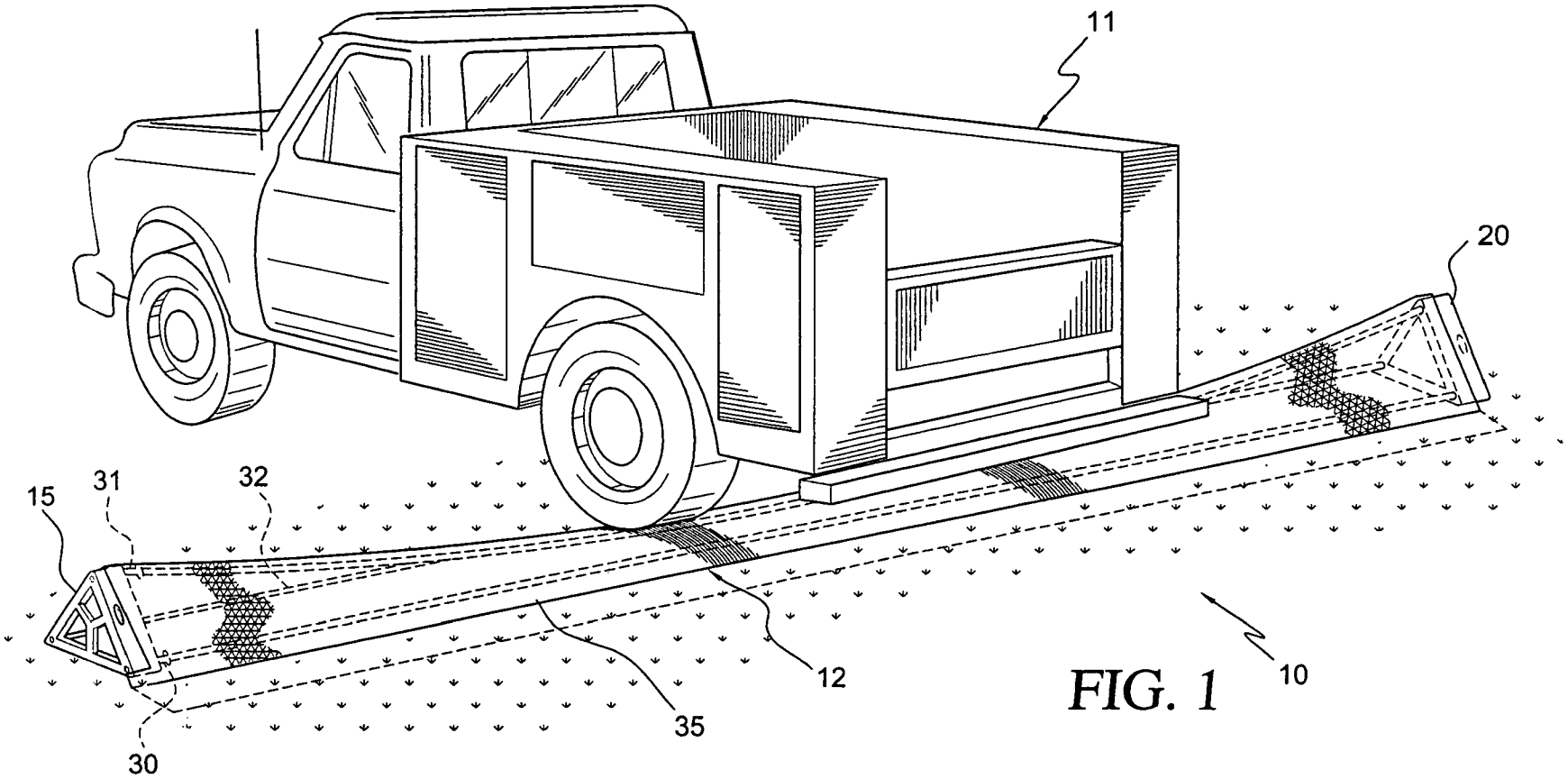
FIG. 1 is a perspective view of a silt fencing section in accordance with a preferred embodiment of the invention.

With initial reference to FIG. 1, a silt fencing system 10 constructed in accordance with the present invention is shown being driven over by a truck 11 leaving a construction site. Silt fencing system 10 includes a fencing section 12 that is collapsible as shown. Fencing section 12 comprises a triangularly shaped first framing member or male member 15, a triangularly shaped second framing member or female member 20, tension rods 30-32 and a fencing material 35. As shown in FIG. 1, tension rods 30-32 are collapsible, allowing a truck to drive over fencing section 12 without destroying fencing section 12. It is preferred that tension rods 30-32 are of such a length that gives flexibility to fencing section 12. The length of tension rods 30-32 are able to bend without affecting male member 15 and female member 20, while fencing material 35 drops with tension rods 30-32. Once the truck has passed, fencing section 12 re-assumes its original form.

Figure 2:
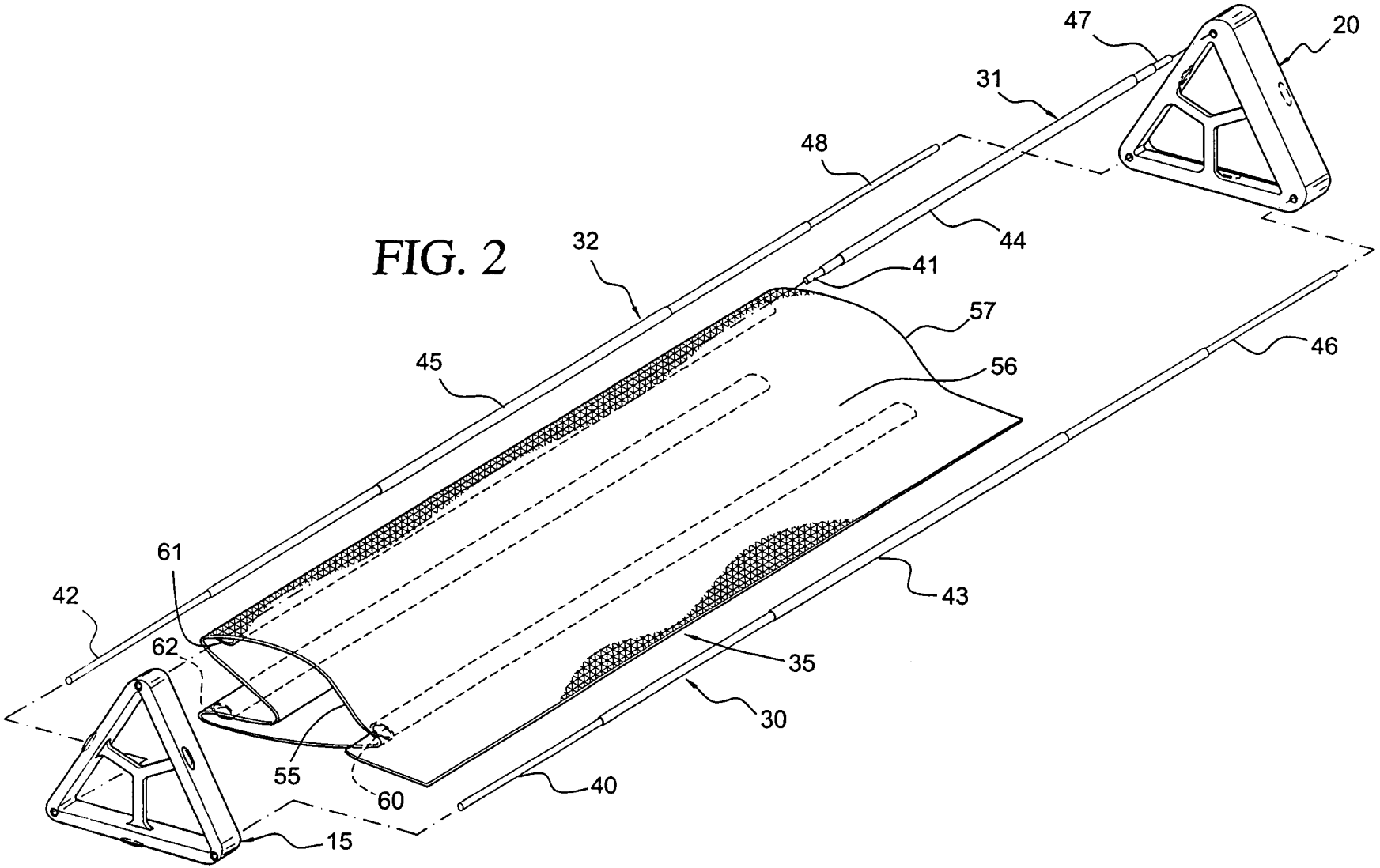
FIG. 2 is an exploded view of the silt fencing section of FIG. 1.

Referring to FIG. 2, tension rods 30-32 have corresponding front ends 40-42, corresponding intermediate portions 43-45 and corresponding rear ends 46-48. As shown in FIG. 2, tension rods 40-42 are telescopic. However, tension rods 30-32 do not need to be telescopic, as shown in FIG. 1. Tension rods 30-32 are preferably made out of metal, such as aluminum, steel or titanium. It is preferable that rods 30-32 be made out of a metal that is the most cost efficient. However, it is recognized that rods 30-32 may be made out of any material with enough strength to prevent soil and sediment erosion.

Figure 3:
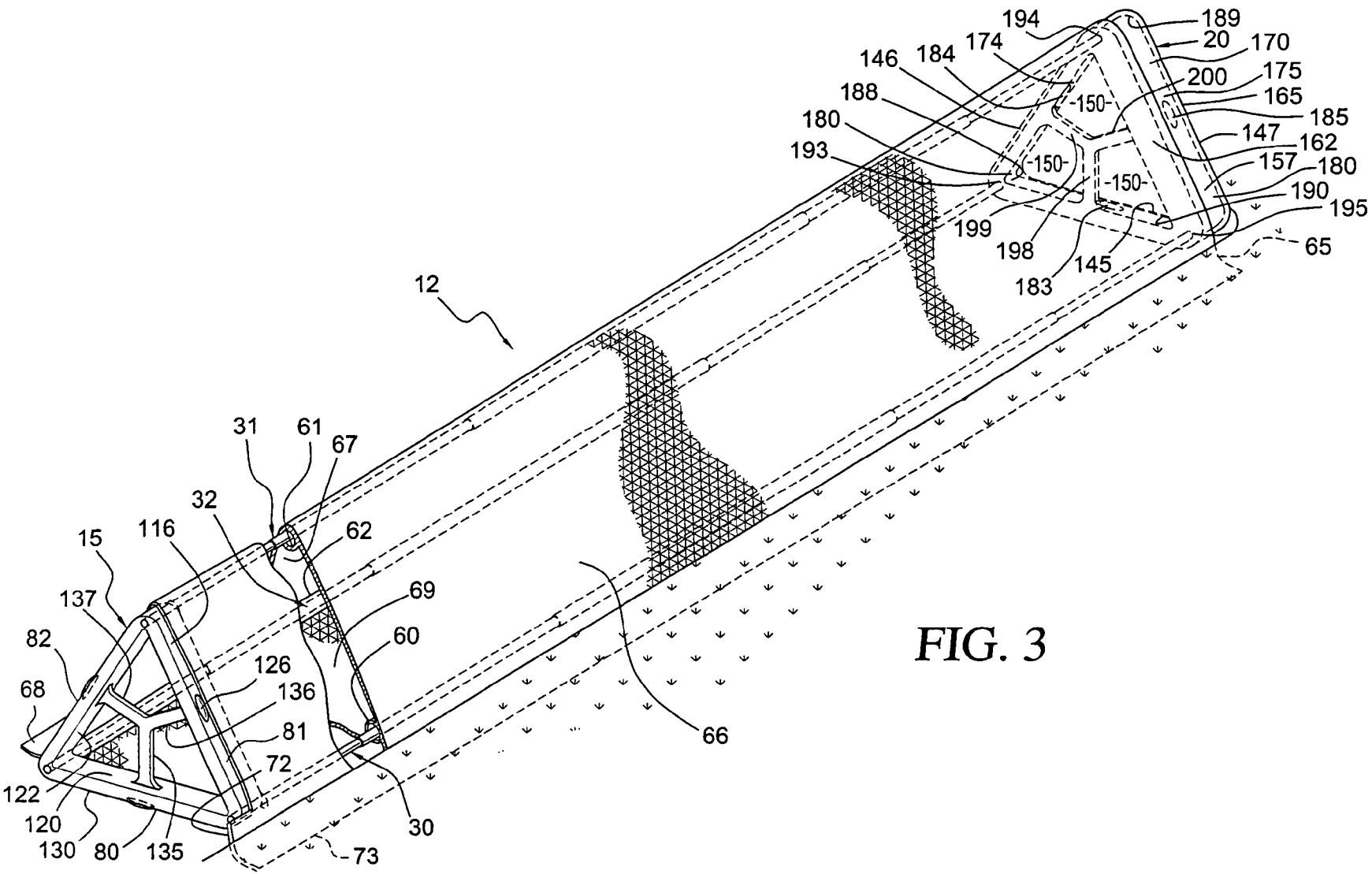
FIG. 3 is a perspective view of the silt fencing section in accordance with a preferred embodiment of the invention.
Figure 6:
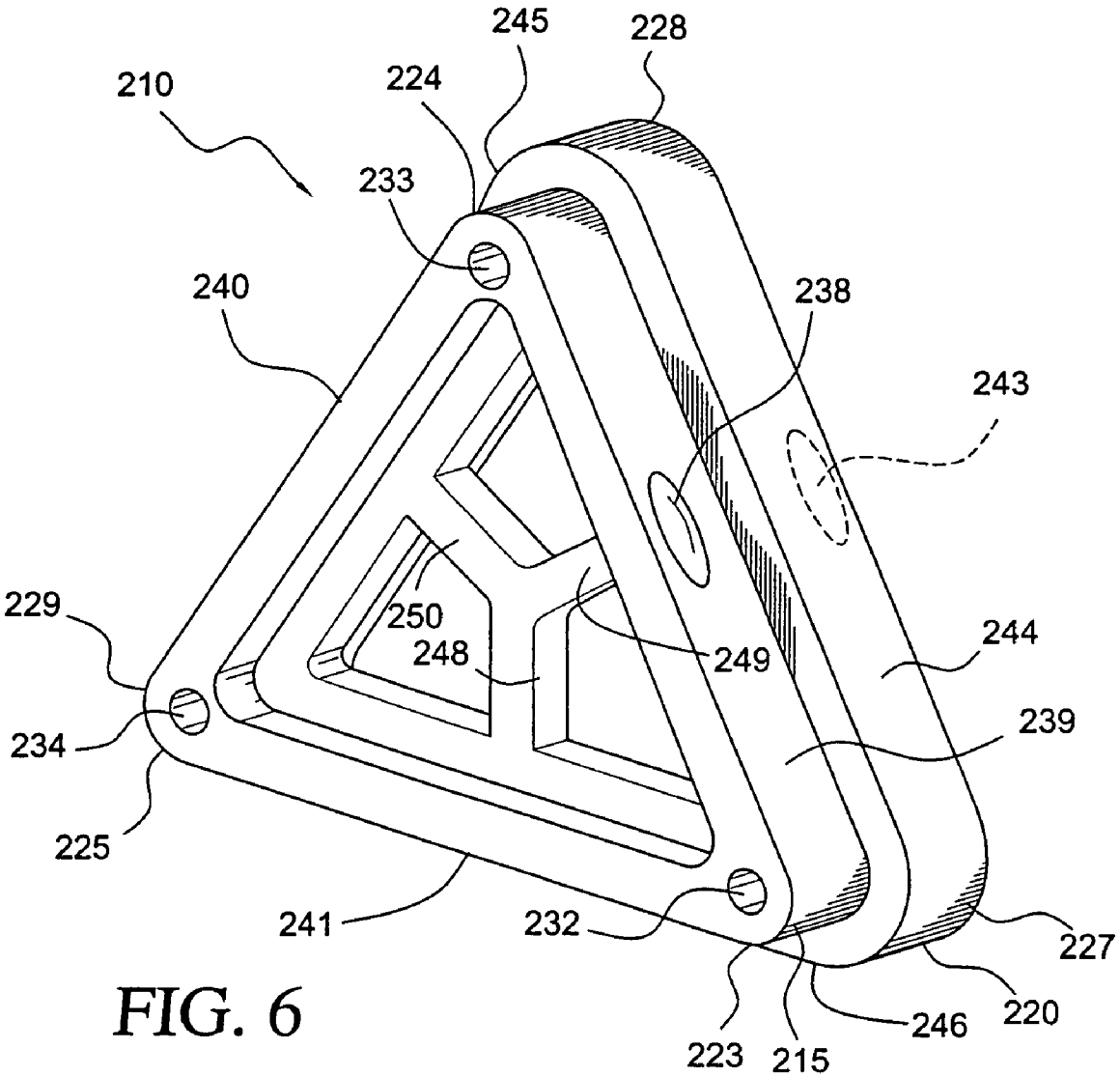
FIG. 6 is a perspective view of an alternate embodiment wherein the male member and female member are one piece.

With reference to FIGS. 2 and 3, fencing material 35 preferably extends the distance between male member 15 and female member 20. Fencing material 35 has a front end 55, an intermediate portion 56, and a rear end 57. Fencing material 35 has three circular shaped sleeve supports 60-62 that extend the length of intermediate portion 56. Sleeve supports 60-62 are located in fencing material 35 so as to longitudinally divide fencing material into five sections 65-69. Section 65 is divided into portions 72 and 73. Section 65 faces the construction site. Portion 73 is buried underground to prevent sediment and soil flowing under fencing section 12. Section 65 has a longer length than sections 66-69, preventing sediment and soil from flowing underneath a connection between male member 15 and female member 20, as shown in FIG. 6. Fencing material can be made of any known material that is used to prevent soil and sediment erosion.

Figure 4:
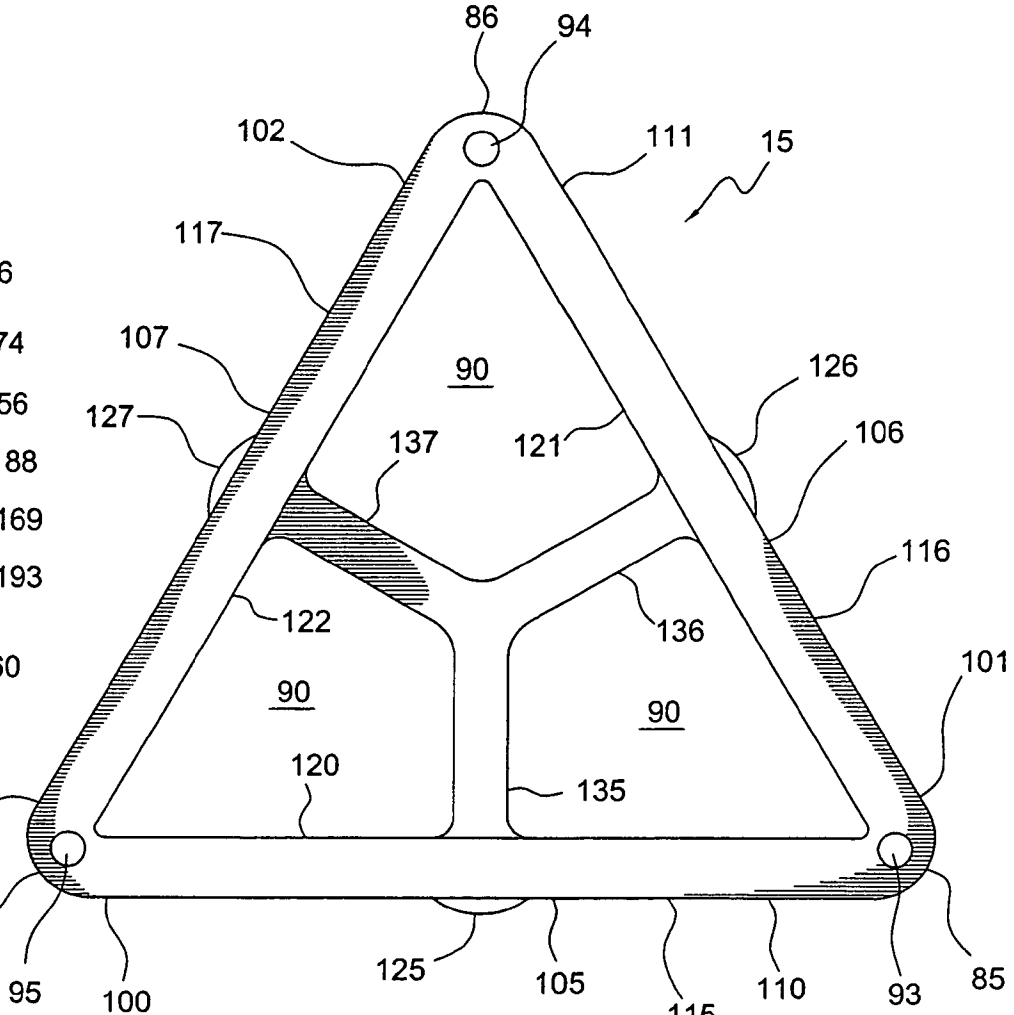
FIG. 4 is a front view of the male member of the silt fencing section of FIG. 1.

As shown in FIGS. 3 and 4, male member 15 has three side walls 80-82 that form the triangular shape of male member 15 having corners 85-87 defining an open area 90. Each corner 85-87 has a respective slot 93-95 inserted therein. Each side wall 80-82 has a corresponding front end 100-102, a corresponding intermediate portion 105-107 and a corresponding rear end 110-112. Each side wall 80-82 has a corresponding outer surface 115-117 and corresponding inner surfaces 120-122. Each outer surface 115-117 has a protrusion 125-127 located in intermediate portion 105-107 of each side wall 80-82 and placed towards a male section front end 130. Each inner surface 120-122 includes a corresponding branch 135-137. Branches 135-137 extend from their respective inner surfaces 120-122 into an open area 90, defined by an open lattice, and intersect each other at angles to form a Y-shape.

Figure 5:
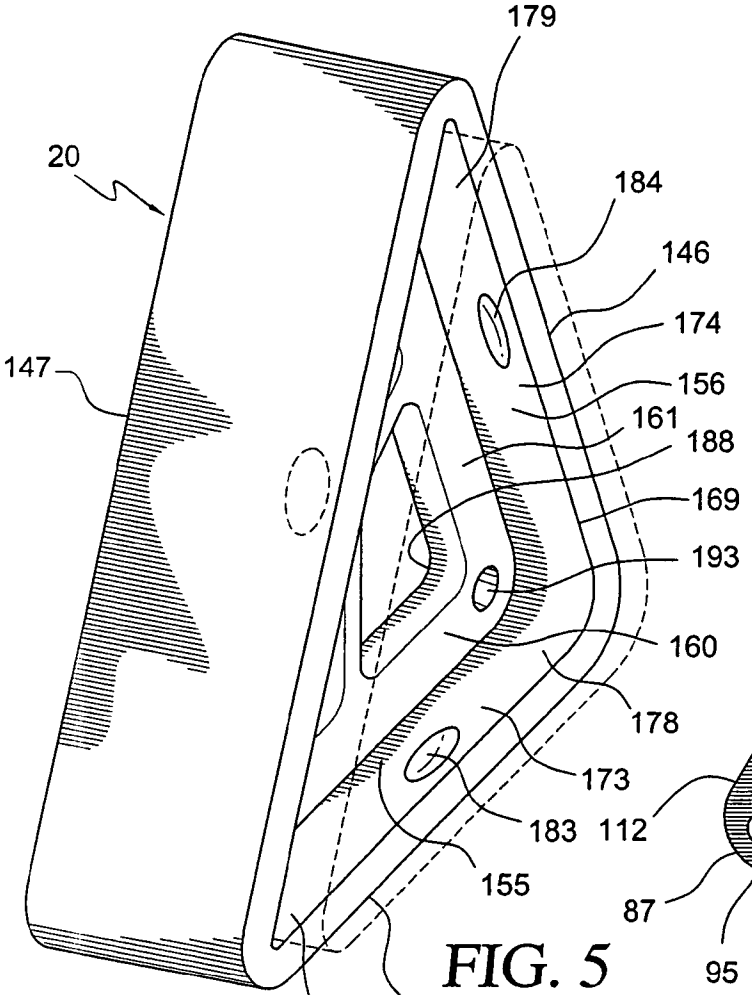
FIG. 5 is a perspective view of a female member and a male member being connected together.

With reference to FIGS. 3 and 5, female member 20 has three side walls 145-147 that form the triangular shape of female member 20 and define an open area 150. Each side wall 145-147 has a corresponding lower inner surface 155-157 and a corresponding upper inner side 160-162. Lower inner surfaces 155-157 are located towards a female member front end 165. Each lower inner surface 155-157 has a corresponding lower inner front end 168-170, a corresponding intermediate portion 173-175 and a corresponding rear end 178-180. Indentations 183-185 are located in corresponding intermediate portions 173-175. Upper inner sides 160-162 intersect with each other to form corners 188-190 having corresponding slots 193-195 inserted therein. In addition, each upper inner side 160-162 has a corresponding branch 198-200 that extends into open area 150. Branches 198-200 intersect each other to form a Y-shape and open area 150 is defined by an open lattice.

Male member 15 and female member 20 are preferably made out of plastic. However, male member 15 and female member 20 may be made out of any material that is cost efficient and light enough to allow for easy transportation of fencing section 12. As shown, male member 15 and female member 20 are separate pieces. However, male member 15 and female member 20 may be combined to form one piece.

Fencing section 12 can be easily assembled and disassembled. Male member 15, female member 20, fencing material 35 attached to male member 15 and female member 20, and tension rods 30-32 are transported to a construction site where fencing section 12 is to be assembled. Preferably, at front end 55, sections 66, 67, and 69 are attached to corresponding side walls 81, 82, and 80 of male member 15 by glue. Likewise, at rear end 57, sections 66, 67, and 69 are preferably attached to corresponding side walls 147, 146 and 145 of female member 20 by glue. To assemble fencing section 12, front ends 40-42 of tension rods 30-32 are inserted into corresponding slots 195, 194 and 193 of female member 20 and then guided through corresponding sleeve supports 60-62 of fencing material 35 into corresponding slots 93-95 of male member 15. Once front ends 40-42 of tensions rods 30-32 are inserted into corresponding slots 93-95 of male member 15, the length of tension rods 30-32 ensures that rear ends 46-48 of tension rods 30-32 are located in corresponding slots 195, 194 and 193 of female member 20. The length of rods 30-32 are preferred to be long enough for a truck to drive over tension rods 30-32 without dislocating rods 30-32 from slots 93-95 and 193-195. Although an installation process is described above, it should be readily apparent that installation can begin with tension rods 30-32 being inserted into male member 15.

When tension rods 30-32 are telescopic, fencing section 12 does not need to be assembled and disassembled for easy transportation. When tension rods 30-32 are telescopic, fencing section 12 may be compressed and extended without removing rods 30-32. When fencing section 12 is compressed, it may easily be transported without the need to disassemble fencing section 12. Fencing section 12 is compressed by pushing male member 15 and female member 20 towards each other.

Shown in FIG. 5, female member 20 is adapted to receive male member 15. Male member 15 is inserted into female member 20 so as to have protrusions 125-127 mate with corresponding indentations 183, 185 and 184. When each protrusion 125-127 mates with corresponding indentations 183, 185 and 184, slots 93-95 of male member 15 align with slots 195, 194 and 193 of female member 20. Since slots 93-95 align with slots 195, 194 and 193, male member 15 and female member 20 and are ensured to be aligned.

A third framing member or hermaphroditic member 210 is shown in FIG. 6. A male part 215 extends from a female part 220. As can be seen in FIG. 6, male part 215 is of a similar triangle shape as female part 220, but smaller. Male part 215 has corners 223-225. Female part 220 has corners 227-229. A slot 232 is inserted through matching corners 223 and 227. A slot 233 is inserted through matching corners 224 and 228 and a slot 234 is inserted through matching corners 225 and 229. Furthermore, male part 215 has a protrusion 390 on at least one corresponding a side wall 239. Male part 215 has two additional side walls 240 and 241. Male part 215 is similar to male member 15 and will therefore not be described in further detail. Female part 220 has an indentation 243 on at least a one corresponding side wall 244. Female part 220 has two additional side walls 245 and 246. Female part 220 is similar to female member 15 and will therefore not be described in further detail. Branches 248-250 extend from where male part 215 meets female part 220. Branches 248-250 intersect each other and form a Y-shaped open lattice structure.

Figure 7:
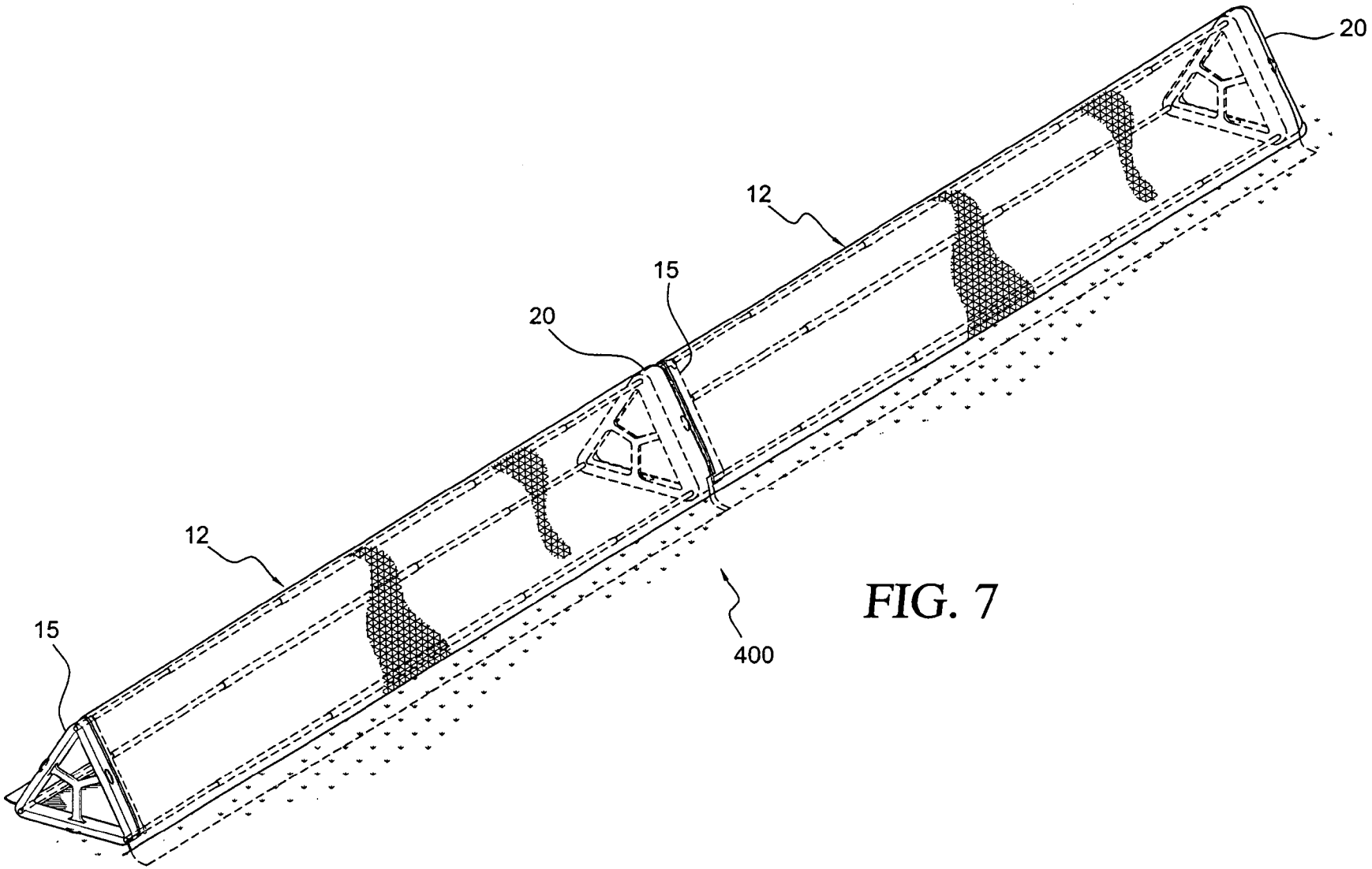
FIG. 7 is a perspective view of the silt fencing section of FIG. 1 connected with a similar fencing section.

When a fence longer than fencing section 12 is needed, the connection between female member 20 and male member 15 allow such a fence to be built. As shown in FIG. 7, two fencing sections 12 engage each other to form a silt fencing system 400. The connection of male member 15 with female member 20 is shown in detail in FIG. 3. Multiple fence sections are combined until a desired fence length is obtained.

Based on the above mentioned disclosure, it should be readily apparent that the invention provides an easily transportable, reusable, low cost and clean fence that prevents soil and sediment erosion. The fencing section does not require fencing material to be stapled to wooden stakes. The fencing section can be easily compressed and transported. In addition, the use of telescopic rods enables the fencing section to be compressed and easily transported without removing the rods. Since the fencing section has a female member and a male member, the fencing section can be combined with other identical fencing sections to form a larger fence. Furthermore, construction vehicles can easily access a construction site by driving over the fencing section without destroying the fencing section. The fencing section can collapse when a vehicle is driving over it and then retain its original form once the vehicle has passed. Unlike a foam barrier, the fencing section does not develop an undesirable odor. Therefore, the fencing section does not need to be replaced due to developing an odor. Lastly, the fencing section of the present invention allows for parts to be replaced without replacing an entire fencing section.

Although described with reference to a preferred embodiment of the invention, it should be readily understood that various changes and/or modifications can be made to the invention without departing from the spirit thereof. For instance, tension rods may be one piece elongated rods, telescopic, or analogous to those for assembling tents or anything similar that is known in the art. The fencing section may be anchored to the ground with anchor holes in the fencing material and using anchor stakes to ensure the fencing material is anchored to the ground. Additionally, when joining multiple fencing sections, an intermediate portion can accommodate rods from both fencing sections, thereby requiring one framing member instead of two framing members. Therefore, a first fencing section would have first and second framing members and a second fencing section would only have a third framing member. In general, the invention is only intended to be limited by the scope of the following claims.

I claim:

1. A silt fencing system for use in a construction site to prevent sediment and soil erosion comprising:

a first fencing section including:

a first framing member establishing a first end of the first fencing section, the first framing member having a main body having opposing side walls, a central portion and a plurality of corners, a slot in at least one of the plurality of corners, and plurality of interconnected branches extending from the main body into the central portion, wherein the central portion is defined by an open lattice;

a second framing member establishing a second end of the first fencing section, a first plurality of rods extending between and interconnecting the first and second framing members, and a first piece of flexible fencing material extending between the first and second framing members and being supported by the first plurality of rods;

a second fencing section including:

a third framing member, a second plurality of rods extending between and interconnecting the third framing member and the first fencing section, and a second piece of flexible fencing material extending between the third framing member and the first fencing section, while being supported by the second plurality of rods; and wherein the first and second fencing sections join to establish a barrier adapted to be used at a construction site for ground erosion control purposes.

2. A silt fencing system for use in a construction site to prevent sediment and soil erosion comprising:

a fencing section including:

a first framing member establishing a first end of the fencing section, a second framing member establishing a second end of fencing section, a plurality of rods extending between and interconnecting the first and second framing members, and a piece of flexible fencing material extending between the first and second framing members and being supported by the plurality of rods, wherein the fencing section establishes a barrier adapted to be used at a construction site for ground erosion control purposes and each of the plurality of rods are telescopic to selectively vary a width of the fencing section.

3. The silt fencing system of claim 2, wherein at least one of the plurality of rods is flexible such that the fencing section will deflect from an original form and then re-assume the original form upon being driven over by a vehicle.

4. The silt fencing system of claim 2, wherein each of the first and second framing members has at least three sides and opposing face portions, at least one of the opposing face portions including a plurality of slots, each of the plurality of rods extending into respective ones of the plurality of slots to interconnect the first and second framing members.

5. The silt fencing system of claim 4, wherein one of the opposing faces of the first framing member includes a protrusion and one of the opposing faces of the second framing member includes an indentation, wherein the indentation can matingly receive the protrusion.

6. The silt fencing system of claim 2, further comprising:

another fencing section including:

a third framing member, a second plurality of rods extending between and interconnecting the third framing member and the first fencing section, and a second piece of flexible fencing material extending between the third framing member and the first fencing section, while being supported by the second plurality of rods.

7. The silt fencing system of claim 6, wherein the another fencing section further includes a fourth framing member, said second plurality of rods extending between and interconnecting the third and fourth framing members.

8. The silt fencing system of claim 7, wherein each of the second and fourth framing members has at least three sides and opposing face portions, with one of the opposing face portions of the fourth framing member including a protrusion and one of the opposing face portions of the second framing member including a recess, wherein the protrusion of the fourth framing member is matingly received by the recess of the second framing member.

9. The silt fencing system of claim 8, wherein at least the second and fourth framing members are identically constructed.

* * * * *